US006967901B2

(12) United States Patent
Shimizu

(10) Patent No.: US 6,967,901 B2
(45) Date of Patent: Nov. 22, 2005

(54) RADIO-CONTROLLED TIMEPIECE AND CONTROL METHOD FOR A RADIO-CONTROLLED TIMEPIECE

(75) Inventor: Eisaku Shimizu, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 251 days.

(21) Appl. No.: 10/393,553

(22) Filed: Mar. 21, 2003

(65) Prior Publication Data

US 2003/0198140 A1 Oct. 23, 2003

(30) Foreign Application Priority Data

Mar. 26, 2002 (JP) ..... 2002-086740
Sep. 6, 2002 (JP) ..... 2002/261218

(51) Int. Cl.[7] ..... G04B 47/00
(52) U.S. Cl. ..... 368/47
(58) Field of Search ..... 368/47, 10, 46

(56) References Cited

U.S. PATENT DOCUMENTS 5,177,714 A * 1/1993 Ganter et al. ..... 368/47
5,528,560 A * 6/1996 Ogiyama ..... 368/47
6,343,051 B1 1/2002 Yabe et al. ..... 368/41

FOREIGN PATENT DOCUMENTS

CN 1329291 A 1/2002
CN 1122894 C 10/2003
EP 0 657 793 A1 6/1996
EP 0 935 178 A2 8/1999
EP 1 126 340 A2 8/2001
JP 5-52789 7/1993
JP 5-249262 9/1993
JP 7-198876 8/1995
JP H7-198876 * 8/1995
JP 11-223684 8/1999
JP 2973303 9/1999
JP 2000-235093 8/2000

* cited by examiner

*Primary Examiner*—Vit W. Miska
(74) *Attorney, Agent, or Firm*—Mark P. Watson

(57) ABSTRACT

A radio-controlled timepiece reduces unnecessary power consumption and improves energy conservation. The radio-controlled timepiece has a reception unit power supply controller 43 that regularly operates a reception power supply circuit 24 that drives a reception circuit 22 for receiving a radio signal containing time information. The reception unit power supply controller 43 has an elapsed time detector 110 for determining or measuring the elapsed time from the last time a signal was received, a reception schedule storage 130 for storing schedule information for supplying power, a schedule information setting-unit 120 for changing the schedule information to schedule information B with a longer power supply time interval than a default setting A if the elapsed time becomes greater than or equal to a set time, and a power supply circuit controller 140 that controls operation of the reception power supply circuit 24 based on the schedule information. Because the frequency of signal reception is reduced if the period in which signal reception is not possible increases, power consumption can be reduced.

24 Claims, 10 Drawing Sheets

RADIO-CONTROLLED TIMEPIECE AND CONTROL METHOD FOR A RADIO-CONTROLLED TIMEPIECE

BACKGROUND OF THE INVENTION

1. Field of the Invention

The present invention relates to a radio-controlled timepiece and to a control method for a radio-controlled timepiece.

2. Description of the Related Art

Radio-controlled timepieces that receive a longwave standard radio signal with superposed time information and automatically adjust the time based on the received signal are known. See particularly Japanese Patent 2973303, paragraphs [0022] to [0027]. In addition to forced reception, which is activated by the user operating the crown or a button to force the timepiece to receive the standard radio signal, this radio-controlled timepiece also has an automatic reception mode in which the timepiece automatically receives the standard time signal at a preset reception time and automatically adjusts the time based on the time information in the received signal.

A problem with such radio-controlled timepieces is that depending upon the conditions of the surrounding electrical environment the timepiece may not be able to receive the time signal. Local magnetic fields, for example, could interfere with reception, and reception might not be possible inside some buildings. Reception may also not be possible when travelling abroad, or simply when in areas outside the range of the standard time signal transmitter.

Even if the automatic reception function operates under such circumstances the timepiece will be unable to receive the signal and the time will not be adjusted.

Attempting reception despite being unable to receive the signal needlessly consumes power. This reception operation is the most power-consuming operation of the timepiece, and in a battery-powered timepiece such as a wristwatch, results in a shortened battery life.

OBJECTS OF THE INVENTION

An object of the present invention is therefore to provide a radio-controlled timepiece and a control method for a radio-controlled timepiece that can improve energy efficiency by suppressing unnecessary power consumption.

SUMMARY OF THE INVENTION

A radio-controlled timepiece according to the present invention has a timekeeping unit that measures current time based on a reference clock, a current time display that displays the measured current time, a reception unit that receives a radio signal containing time information, a reception power supply controller that regularly operates a reception power supply that drives the reception unit, and a current time adjusting unit that adjusts the current time of the timekeeping unit based on the time information received by the reception unit.

The reception power supply controller has an elapsed time detector that determines an elapsed time from when a previous radio signal was received, a schedule information setting-unit that sets schedule information defining an operating time interval at which the reception power supply is regularly operated, and a power supply controller that controls operation of the reception power supply based on the schedule information.

The schedule information setting-unit changes the schedule information to schedule information with a longer operating time interval than a default setting when the elapsed time becomes greater than or equal to a set time.

A so-called standard time signal in which time information is set in a specified format can be suitably used as the radio signal containing the time information, but even radio signals with an indeterminate format can be used if time information is carried and the time information can be obtained by receiving the signal.

With the present invention the timekeeping unit normally keeps the current time by counting the reference clock, and the current time is displayed by the current time display unit.

The reception power supply controller regularly operates the reception power supply based on the schedule information to provide a power source (supply power) to and drive the reception unit. For example, if the default setting of the schedule information is one day, power is supplied to the reception unit daily (such as daily at 2:00 a.m.) so that the reception unit is operated regularly. During operation a radio signal containing time information is received, and if the time information in the received signal is correct the current time is adjusted by the current time adjusting unit based on the received time information.

On the other hand, if the signal containing time information cannot be received during the regular reception operation, the time is not adjusted.

If such reception failures continue and the time passed since the previous signal reception detected by the elapsed time detector is greater than or equal to a set time (such as seven days), the schedule information setting-unit sets the schedule information to a schedule with a longer operating time interval (power source supply time interval) than the default setting. If the default setting is one day, the schedule could be changed to every five days, for example.

Therefore, the reception power supply controller thereafter drives the reception unit based on schedule information with a longer operating time interval (such as five days) and attempts signal reception.

As a result, because the reception interval is changed from once a day to once in five days, for example, when signal reception fails for an extended period of time because the radio-controlled timepiece is located inside a building or other location where signal reception is difficult or the timepiece is being used while travelling or working overseas, for example, the number of signal reception operations is reduced accordingly and power consumption is likewise reduced. Battery life can therefore be extended if the timepiece is battery powered, and energy conservation can be improved when the timepiece uses a commercial power source from an outlet.

It should be noted that plural set times can be defined and the reception power supply controller could further increase the interval for regularly supplying power to the reception unit as each set time is passed. In other words, the schedule information setting-unit sequentially changes to schedule information with a longer power supply time interval each time the elapsed time passes each set time.

For example, if three set times are defined, such as a first set time of 7 days, a second set time of 20 days, and a third set time of 40 days, the schedule information is first changed to a time interval longer than the default setting when the elapsed time is greater than or equal to 7 days so that reception is set to occur, for example, once every five days. If the elapsed time then increases to 20 days or more, the interval for regularly supplying power to the reception unit is set to an even longer time interval so that reception occurs once every 10 days, for example. If the elapsed time then increases to 40 days or more, the interval for regularly supplying power to the reception unit is then set to an even longer time interval so that reception occurs once every 20 days, for example. By thus defining plural set times and gradually increasing the power supply time interval when each set time is passed, power consumption by the reception operation is further decreased and energy conservation can be further improved.

Preferably, the reception power supply controller has a reception schedule storage (e.g. memory) that stores the schedule information, the schedule information setting-unit selects schedule information from plural predefined reception schedules according to the elapsed time and stores the selected schedule information in the reception schedule storage, and the power supply controller controls operation of the reception power supply based on the schedule information stored in the reception schedule storage.

The schedule information setting-unit could have an operating unit storing a specific equation for outputting schedule information according to the elapsed time when the elapsed time is input. If plural schedules are also preset and the selected schedule information is stored in the reception schedule storage for control, greater freedom is achieved in setting the schedule and the schedule can be set more easily.

Further preferably, the schedule information setting-unit receives radio signals by the reception unit, and sets the schedule information to a default setting when correct time information is received.

If thus comprised the reception schedule is automatically reset to the default setting even when the reception interval is long if the time signal is successfully received. Signal reception thereafter continues at the interval of the default setting and the normal operating state is restored. In other words, because the likelihood is high that subsequent signals can also be received once a signal is received, reception can be reset to the original once-a-day schedule if signal reception is successful once. Furthermore, because the time is adjusted based on the received time signal, the time can be displayed with extremely high accuracy.

Further preferably, the power supply controller stops regular operation of the reception power supply when the elapsed time is greater than or equal to a second set time that is longer than the above-noted set time.

For example, if the above-noted set time is 7 days and the second set time is 20 days, the schedule information is first changed to a time interval longer than the default setting (such as once every five days) when the elapsed time is greater than or equal to 7 days. However, if the elapsed time then increases to 20 days or more, regular operation of the reception power supply is stopped and regular supply of power to the reception unit is stopped completely. In this case the reception unit does not operate until the user performs a specific operation to force reception. Power consumption by the reception operation is therefore eliminated, and even greater energy conservation can be achieved. This is particularly useful in a battery-powered timepiece because the battery life can be extended even further.

A further radio-controlled timepiece according to the present invention has a timekeeping unit that measures current time based on a reference clock, a current time display that displays the measured current time, a reception unit that receives a radio signal containing time information, a reception power supply controller that regularly operates a reception power supply that drives the reception unit, and a current time adjusting unit that adjusts the current time of the timekeeping unit based on the time information received by the reception unit, an electric generator that produces electric power using energy from an external source, and a power storage (e.g. battery, capacitor, etc.) that stores power generated by the electric generator.

The reception power supply controller in this radio-controlled timepiece preferably has a power generation detector that detects electric power generation by the electric generator, an elapsed time detector that determines the elapsed time from when the previous radio signal was received, a schedule information setting-unit that sets schedule information defining the operating time interval at which the reception power supply is regularly operated, and a power supply controller that controls operation of the reception power supply based on the schedule information.

The schedule information setting-unit changes the schedule information to a schedule with a longer operating time interval than a default setting when the elapsed time becomes greater than or equal to a set time and power generation is not detected even once after elapsed time measurement starts.

With the present invention the timekeeping unit normally keeps the current time by counting the reference clock, and the current time is displayed by the current time display unit.

The reception power supply controller regularly operates the reception power supply based on the schedule to provide a power source (supply power) to and drive the reception unit. During operation a radio signal containing time information is received, and if the time information in the received signal is correct the current time is adjusted by the current time adjusting unit based on the received time information.

On the other hand, if the signal cannot be received during the regular reception operation, the time is not adjusted.

If such reception failures continue and the time passed since the previous signal reception detected by the elapsed time detector is greater than or equal to a set time and power generation is not detected even once after elapsed time measurement starts, the schedule information setting-unit sets the schedule information to a schedule with a longer operating time interval (power source supply time interval) than the default setting. If the default setting is one day, the schedule could be changed to every five days, for example. Therefore, thereafter the reception power supply controller drives the reception unit based on schedule information with a longer operating time interval (such as five days) and attempts signal reception.

As a result, if no power is generated and signal reception also fails, such as when a timepiece with a solar battery as the electric generator is placed inside a drawer, the reception interval is increased and power consumption can be reduced accordingly. The timepiece can therefore continue to operate for a longer time when power is not produced. Furthermore, because the signal reception interval continues as usual when power is generated, the probability of successful signal reception increases and the timepiece can continue to highly accurately display the time.

Preferably, the reception power supply controller has a reception schedule storage that stores the schedule information, the schedule information setting-unit selects schedule information from plural predefined reception schedules according to the elapsed time and whether power generation was detected and stores the selected schedule information in the reception schedule storage, and the power supply controller controls operation of the reception power supply based on the schedule information stored in the reception schedule storage.

By thus providing a reception schedule storage and storing plural reception schedules, the reception schedule can be set easily and with a greater degree of freedom.

In addition, the schedule information setting-unit preferably receives radio signals by the reception unit, and sets the schedule information to a default setting when correct time information is received.

Because the schedule information is automatically reset to the default setting when a signal is received and signal reception thereafter proceeds at the interval of the default setting, the normal operating state can be restored, and the time can be displayed with extremely high accuracy because the time is adjusted based on the received time signal.

The schedule information setting-unit preferably sets the schedule information to the default setting when power generation is detected by the power generation detector.

Because the need to conserve energy is reduced if power generation is detected, signal reception can run at the interval of the default setting and the accuracy of the time display can be improved.

Further preferably, the power supply controller stops regular operation of the reception power supply when the elapsed time is greater than or equal to a second set time that is longer than the above-noted set time.

Power consumption by the reception operation is therefore eliminated in this case because the reception unit does not operate, and even greater energy conservation can be achieved. It should be noted that stopping operation of the reception unit is preferably cancelled when the user forces reception or when power generation is detected.

Further preferably, the elapsed time detector resets and restarts measuring the elapsed time when power generation is detected by the power generation detector.

Because the time until the schedule is even longer if the elapsed time is reset and measuring it resumes when power generation is detected, the reception process can continue at the default schedule and the time display can be kept highly accurate.

A further radio-controlled timepiece according to the present invention has a timekeeping unit that measures current time based on a reference clock, a current time display that displays the measured current time, a reception unit that receives a radio signal containing time information, a reception power supply controller that regularly operates a reception power supply that drives the reception unit, and a current time adjusting unit that adjusts the current time of the timekeeping unit based on the time information received by the reception unit.

The reception power supply controller has an elapsed time detector that determines elapsed time from when a previous radio signal was received, a schedule information setting-unit that sets schedule information defining an operating time interval at which the reception power supply is regularly operated, and a power supply controller that controls operation of the reception power supply based on the schedule information.

The power supply controller stops regular operation of the reception power supply and stops driving the reception unit when the elapsed time is greater than or equal to a set time.

A further radio-controlled timepiece according to the present invention has a timekeeping unit that measures current time based on a reference clock, a current time display that displays the measured current time, a reception unit that receives a radio signal containing time information, a reception power supply controller that regularly operates a reception power supply that drives the reception unit, and a current time adjusting unit that adjusts the current time of the timekeeping unit based on the time information received by the reception unit, an electric generator that produces electric power using energy from an external source, and a power storage that stores power generated by the electric generator.

The reception power supply controller has an elapsed time detector that determines elapsed time from when a previous radio signal was received, a power generation detector that detects electric power generation by the electric generator, a schedule information setting-unit that sets schedule information defining an operating time interval at which the reception power supply is regularly operated, and a power supply controller that controls operation of the reception power supply based on the schedule information.

The power supply controller stops regular operation of the reception power supply and stops driving the reception unit when the elapsed time is greater than or equal to a set time and power generation is not detected even once after elapsed time measurement starts.

The power supply controller preferably resumes regular operation of the reception power supply if power generation by the electric generator is detected when regular operation of the reception power supply is stopped.

In each of these aspects of the present invention the reception power supply stops operating and regular supply of a power source (power) to the reception unit is completely stopped if, for example, the set time is 20 days and the elapsed time reaches 20 days or more. In this case the reception unit does not operate until the user performs a specific operation to force reception or power generation is detected if an electric generator is provided, power consumption by the reception operation is therefore eliminated, and even greater energy conservation can be achieved. This is particularly useful in a battery-powered timepiece because the battery life can be extended even further.

Further preferably the radio-controlled timepiece also has an external operation input unit enabling external operation, and the reception power supply controller operates the reception power supply when forced reception is asserted by operation of the external operation input unit.

If the user forces reception by operating the external operation input unit, the user can make the timepiece receive the time signal when required when the interval between the reception operations is long or the reception unit has been completely stopped from operating. If signal reception then succeeds the elapsed time is reset to less than the set time, and a control mode increasing the reception interval or a control mode in which automatic reception is prohibited can be automatically cancelled. A separate canceling operation is therefore not needed, and operability can be improved.

Yet further preferably, the elapsed time detector has an elapsed time measuring unit that uses the reference clock to measure the time elapsed since reception of time information by the reception unit.

Because the elapsed time can be measured by counting the same reference clock used by the timekeeping unit, this configuration can share parts with the timekeeping unit, detect the elapsed time according to the value of the counter counting the reference clock, and can easily determine the elapsed time because a computation process is not required.

Yet further preferably, the elapsed time detector has a received time storage that stores time information received by the reception unit, and an elapsed time calculating unit that calculates elapsed time from reception of the time information by the reception unit by calculating a time difference between received time information stored in the received time information storage and a current time measured by the timekeeping unit.

With this configuration an increase in power consumption can be suppressed because the elapsed time can be calculated as the difference between the current time of the timekeeping unit and the time when time information was received only when the reception process is run and it is necessary to determine the elapsed time.

A first control method for a radio-controlled timepiece according to the present invention has a timekeeping step that measures current time based on a reference clock, a current time display step that displays the measured current time, a reception step that receives a radio signal containing time information, and a current time adjusting step that adjusts the current time based on the time information received in the reception step, a reception control step that regularly runs the reception step based on set schedule information, an elapsed time detection step that determines elapsed time from when a previous radio signal was received, and a schedule information setting step that changes the schedule information to schedule information with a longer execution time interval than a default setting when the elapsed time is greater than or equal to a set time.

A second control method according to the present invention for a radio-controlled timepiece having an electric generator that produces electric power using energy from an external source and a power storage that stores power generated by the electric generator has a timekeeping step that measures current time based on a reference clock, a current time display step that displays the measured current time, a reception step that receives a radio signal containing time information, and a current time adjusting step that adjusts the current time based on the time information received in the reception step, a reception control step that regularly runs the reception step based on set schedule information, an elapsed time detection step that determines elapsed time from when a previous radio signal was received, a power generation detection step that detects electric power generation by the electric generator, and a schedule information setting step that changes the schedule information to schedule information with a longer execution time interval than a default setting when the elapsed time is greater than or equal to a set time and power generation is not detected even once after elapsed time measurement starts.

A third control method for a radio-controlled timepiece according to the present invention has a timekeeping step that measuring current time based on a reference clock, a current time display step that displays the measured current time, a reception step that receives a radio signal containing time information, and a current time adjusting step that adjusts the current time based on the time information received in the reception step, a reception control step that runs the reception step based on set schedule information, and an elapsed time detection step that determines elapsed time from when a previous radio signal was received. In this method the reception control step stops execution of the reception step when the elapsed time is greater than or equal to a set time.

A fourth control method according to the present invention for a radio-controlled timepiece having an electric generator that produces electric power using energy from an external source and a power storage that stores power generated by the electric generator has a timekeeping step that measures current time based on a reference clock, a current time display step that displays the measured current time, a reception step that receives a radio signal containing time information, and a current time adjusting step that adjusts the current time based on the time information received in the reception step, a reception control step that runs the reception step based on set schedule information, an elapsed time detection step that determines elapsed time from when a previous radio signal was received, and a power generation detection step that detects electric power generation by the electric generator. The reception control step stops execution of the reception step when the elapsed time is greater than or equal to a set time and power generation is not detected even once after elapsed time measurement starts.

This control methods set forth above achieve the same operating effects as apparatus of the invention described previously.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Preferred embodiments of the present invention are described below with reference to the accompanying figures.

Figure 1:
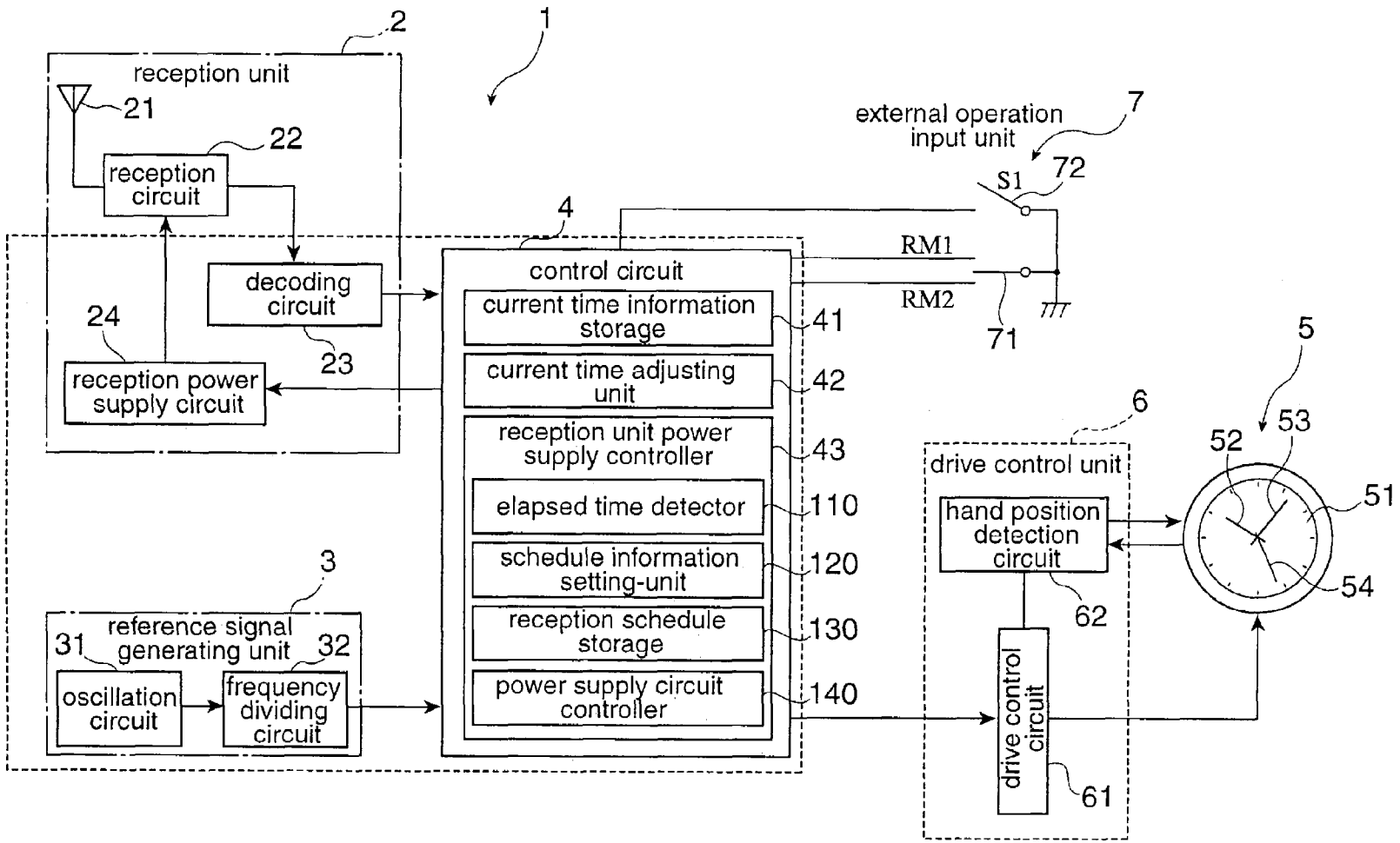
FIG. 1 shows the configuration of a radio-controlled timepiece according to a first embodiment of the present invention.

FIG. 1 shows the configuration of a radio-controlled timepiece 1 according to a first embodiment of the invention.

This radio-controlled timepiece 1 has an analog display, and includes a reception unit 2 as a reception unit that receives a radio signal (a standard signal) containing time information, a reference signal generating unit 3 for generating a reference clock, a control circuit 4 for controlling the timepiece, a display unit 5 as a current time display that displays the time and other information, a drive control unit 6 for controlling driving the display unit 5 based on commands from the control circuit 4, and an external operation input unit 7 for externally operating the timepiece.

The reception unit 2 is composed of an antenna 21 for receiving the standard radio signal containing time information, a reception circuit 22 for processing (amplifying and demodulating, for example) the time information received by the antenna 21, a decoding circuit 23 for decoding time information from the signal processed by the reception circuit 22, and a reception power supply circuit 24 for supplying power to the reception circuit 22. The reception power supply circuit 24 therefore drives the reception unit 2, i.e., the reception unit, and this reception power supply circuit 24 corresponds to the reception power supply of the present invention.

The antenna 21 is, for example, a ferrite antenna having a coil wound to a ferrite rod.

The reception circuit 22 is built to receive radio signals through the antenna 21. The reception circuit 22 also has an amplifier, bandpass filter, and demodulation circuit not shown in the figures, shapes and demodulates the received radio signal for output as a rectangular pulse signal denoting the time code to the decoding circuit 23. The decoding circuit 23 converts this pulse signal and outputs a digital timecode signal to the control circuit 4.

A signal such as JJY longwave standard time signals transmitted in Japan can be used as the standard radio signal containing time information. The time code format signal of this longwave radio signal is transmitted once each second with one record (one frame) transmitted over a period of one minute (60 seconds). In other words, one frame consists of 60 data bits. The specific data fields include the minute and hour of the current time, the number of cumulative days since January 1 of the current year, the year (last two digits of the Gregorian calendar year), day of the week, and leap second. It should be noted that there is no seconds field, but this is because the time information denotes the time at second 0 of the full minute. The value of each field is denoted by a combination of binary values assigned every second, and the on/off states of these combinations are determined from the signal type.

The reference signal generating unit 3 includes an oscillation circuit 31 such as a quartz oscillator, and a frequency dividing circuit 32 for frequency dividing pulses from the oscillation circuit 31 to generate a reference clock (such as 1 Hz). The reference clock is output to the control circuit 4.

Figure 2:
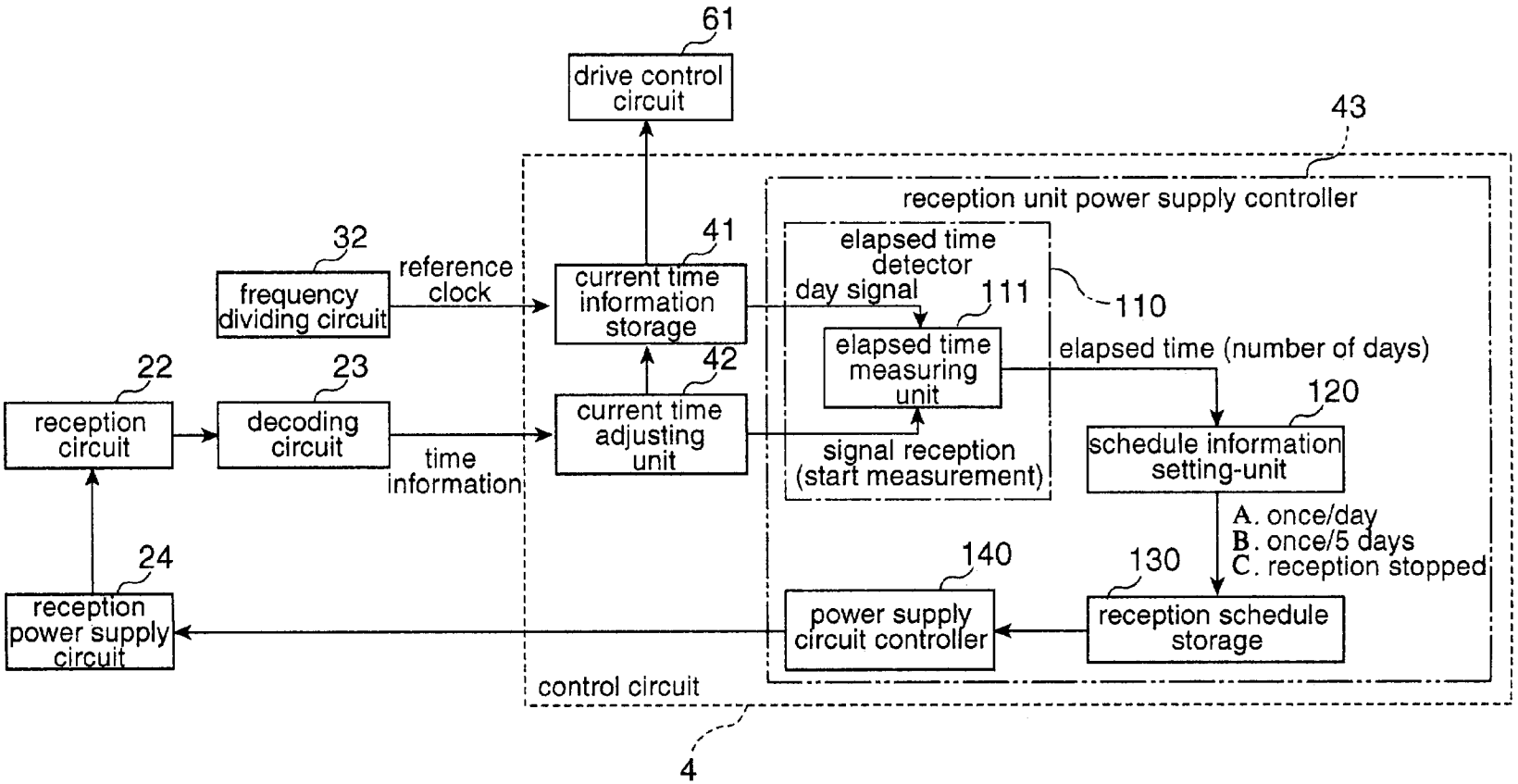
FIG. 2 is a block diagram showing the configuration of the control circuit in this first embodiment.

As shown in FIG. 2, the control circuit 4 includes a current time information storage 41 as a timekeeping unit, a current time adjusting unit 42 for adjusting the current time of the timekeeping unit, and reception unit power supply controller 43 as a reception power supply controller. In other words, the reception unit power supply controller 43 of the present embodiment corresponds to the reception power supply controller of the present invention.

The current time information storage 41 runs a timekeeping process to count the reference clock generated by the reference signal generating unit 3 and measures the current time. The current time measured by the current time information storage 41 is output to and displayed on the display unit 5.

When the time information received by the reception unit 2 is input, the current time adjusting unit 42 runs a current time adjusting process to adjust the current time based on the time information. The current time adjusting unit 42 also determines at this time whether the time information received by the reception unit 2 is accurate or not. If a longwave standard time signal is used, whether the received time information is accurate or not can be determined by, for example, receiving plural frames (normally two or three frames) of the time information transmitted at one minute intervals and determining if the received time information has a specific time difference.

For example, if several time information frames are received consecutively the frames can be compared to determine if the time information denotes times at one minute intervals.

If the received time information is determined to be accurate, the new current time is determined by adding the time elapsed since the time information was received to the received time information, and the current time adjusting unit 42 overwrites the current time in the current time information storage 41 with this new current time.

The reception unit power supply controller 43 is composed of an elapsed time detector 110, schedule information setting-unit 120, reception schedule storage 130, and power supply circuit controller 140.

The elapsed time detector 110 has an elapsed time measuring unit 111 for measuring the time elapsed (days passed) since the time was adjusted by the current time adjusting unit 42.

When the current time adjusting unit 42 adjusts the time, the elapsed time measuring unit 111 receives a signal to start measuring the time, and measures the time by counting the time elapsed (days passed) based on a day signal output at a one day (24 hour) interval from the current time information storage 41.

Because the day signal count is reset and the day signal is counted again in response to a time adjustment signal from the current time adjusting unit 42, that is, a signal indicating that time signal reception succeeded, the elapsed time measuring unit 111 continually counts the time passed to the present from when the reception unit 2 received the previous time signal.

The schedule information setting-unit 120 stores schedule information obtained by the elapsed time detector 110 according to the elapsed time from preset schedule information to the reception schedule storage 130.

As further described below, three types of schedule information are set in this embodiment: schedule information A for receiving the standard time signal once a day, schedule information B for receiving it once every five days, and schedule information C for not receiving the time signal.

The schedule information setting-unit 120 selects and stores schedule information A as the initial setting to the reception schedule storage 130. However, if the elapsed time obtained by the elapsed time detector 110 is greater than or equal to a first time setting, that is, 7 days (168 hours), it selects and stores schedule information B to the reception schedule storage 130, and if the elapsed time is greater than or equal to a second time setting, that is, 20 days (480 hours), it selects and stores schedule information C to the reception schedule storage 130.

The schedule information selected by the schedule information setting-unit 120 is thus set and stored in the reception schedule storage 130, which holds the set schedule information until it is reset to a new value by the schedule information setting-unit 120.

It should be noted that the initial setting is to receive the time signal at 2:00 a.m., for example, when few electrical appliances are operating and reception conditions are generally good. Therefore, when schedule information A is selected, the timepiece is set to receive the time signal every morning at 2:00 a.m. Likewise, when schedule information B is set the timepiece is set to receive the time signal at 2:00 a.m. every five days.

The power supply circuit controller 140 controls operation of the reception power supply circuit 24 based on the schedule information stored to the reception schedule storage 130, and controls supplying power (electrical power, electrical energy) to the reception circuit 22. This power supply circuit controller 140 is therefore equivalent to the power supply controller of the present invention. The schedule information more specifically defines the operating time interval at which the reception power supply circuit 24 is regularly operated.

It should be noted that the power supply circuit controller 140 is set to stop the reception power supply circuit 24 and end the reception operation when a specific time passes after operating the reception power supply circuit 24. It should be noted that how long the reception power supply circuit 24 operates to receive the time signal can be set appropriately to the application. However, because two to six time signal frames are typically received in order to detect whether any noise is included in the time signal, reception continues for two to six minutes using a standard time signal transmitting one frame (one data record) per minute.

The display unit 5 is an analog type having a face 51 with time markings, an hour hand 52, minute hand 53, and second hand 54. The hour hand 52, minute hand 53, and second hand 54 are driven by a stepping motor or other driver, and driving the hands is controlled by commands from the control circuit 4 passed through the drive control unit 6. This display unit 5 thus forms a current time display unit.

The drive control unit 6 has a drive control circuit 61 for receiving commands from the control circuit 4 and outputting a pulse signal to drive the hands of the display unit 5 (hour hand 52, minute hand 53, second hand 54), and a hand position detection circuit 62 for detecting the positions of the hands (hour hand 52, minute hand 53, second hand 54).

Each time the current time of the current time information storage 41 increments and one second is added, the drive control circuit 61 drives the stepping motor based on the motor drive pulse output from the current time information storage 41 and drives the hands.

The external operation input unit 7 consists of the crown 71 and/or one or more pushbutton switches 72. Operation of the crown 71 or pushbutton switch 72 can be determined from the state of the switches RM1, RM2, and S1.

For example, when the crown 71 is pushed all the way in to stop 0, both switches RM1 and RM2 are open. When it is pulled out to the first stop, switch RM1 goes to GND and RM2 is open, and when pulled out to the second stop switch RM1 is open and RM2 goes to GND. In this preferred embodiment of the invention the current time is normally displayed when the crown 71 is at stop 0, and pressing the pushbutton switch 72 on while the crown 71 is at stop 0 forces reception of the time signal due to manual operation.

Operation of a radio-controlled timepiece 1 thus comprised is described next with reference to the flow charts in FIGS. 3 and 4.

Figure 3:
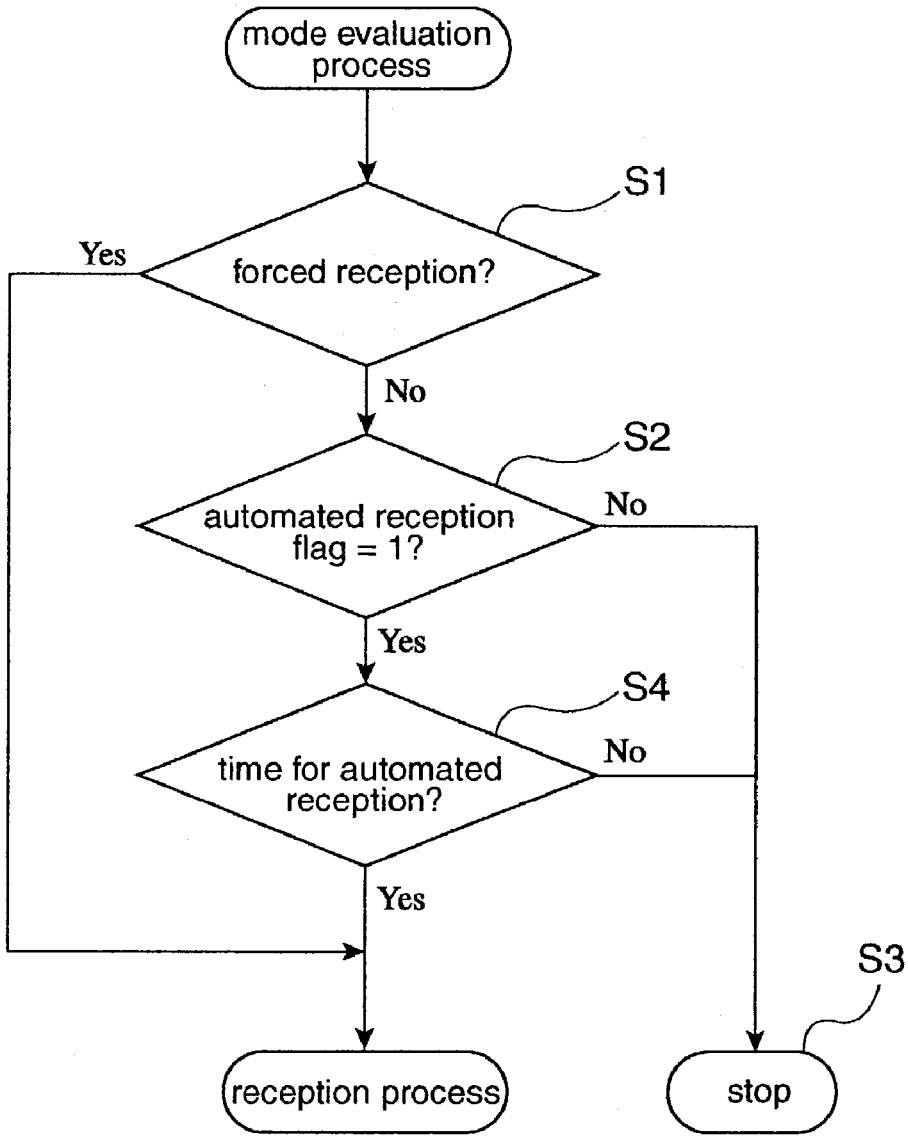
FIG. 3 is a flow chart showing the operation of the mode evaluation process during signal reception in the first embodiment.

During normal operation the reception unit power supply controller 43 of the control circuit 4 detects commands for the time signal reception process, and determines whether a detected command is a manual forced reception command or an automated reception command based on the mode evaluation process shown in the flow chart in FIG. 3. The first step in this process is determining whether a forced reception command was asserted by operating a button (step 1, (steps indicated below by an "S")).

If a forced reception command was not asserted (S1 returns no), whether the automated reception flag is set to 1, that is, whether the automated reception mode is set, is determined (S2). It should be noted that this automated reception flag is set to 1 by default, and is set to 0 when reception is stopped as shown in the flow chart in FIG. 4 described below.

If the automated reception flag is set to 0, that is, reception was stopped, the mode evaluation process ends (S3).

However, if the automated reception flag is set to 1 and the automated reception mode is set, the process determines if the current time is the scheduled reception time set in the reception schedule storage 130, that is, if it is the automated reception time. If it is not time for automated reception, the mode evaluation process ends (S3).

Figure 4:
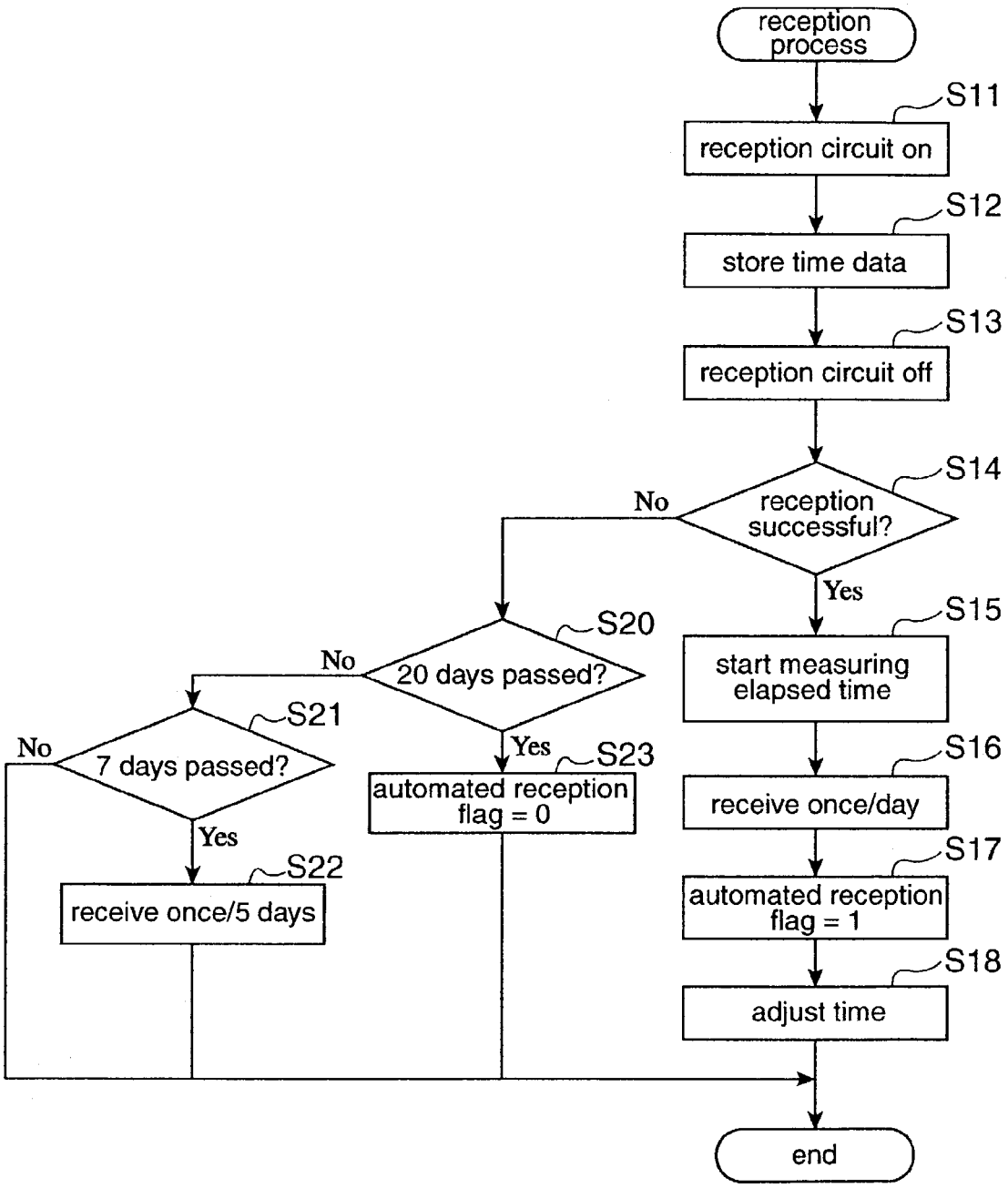
FIG. 4 is a flow chart showing the operation of the signal reception process in the first embodiment.
Figure 5:
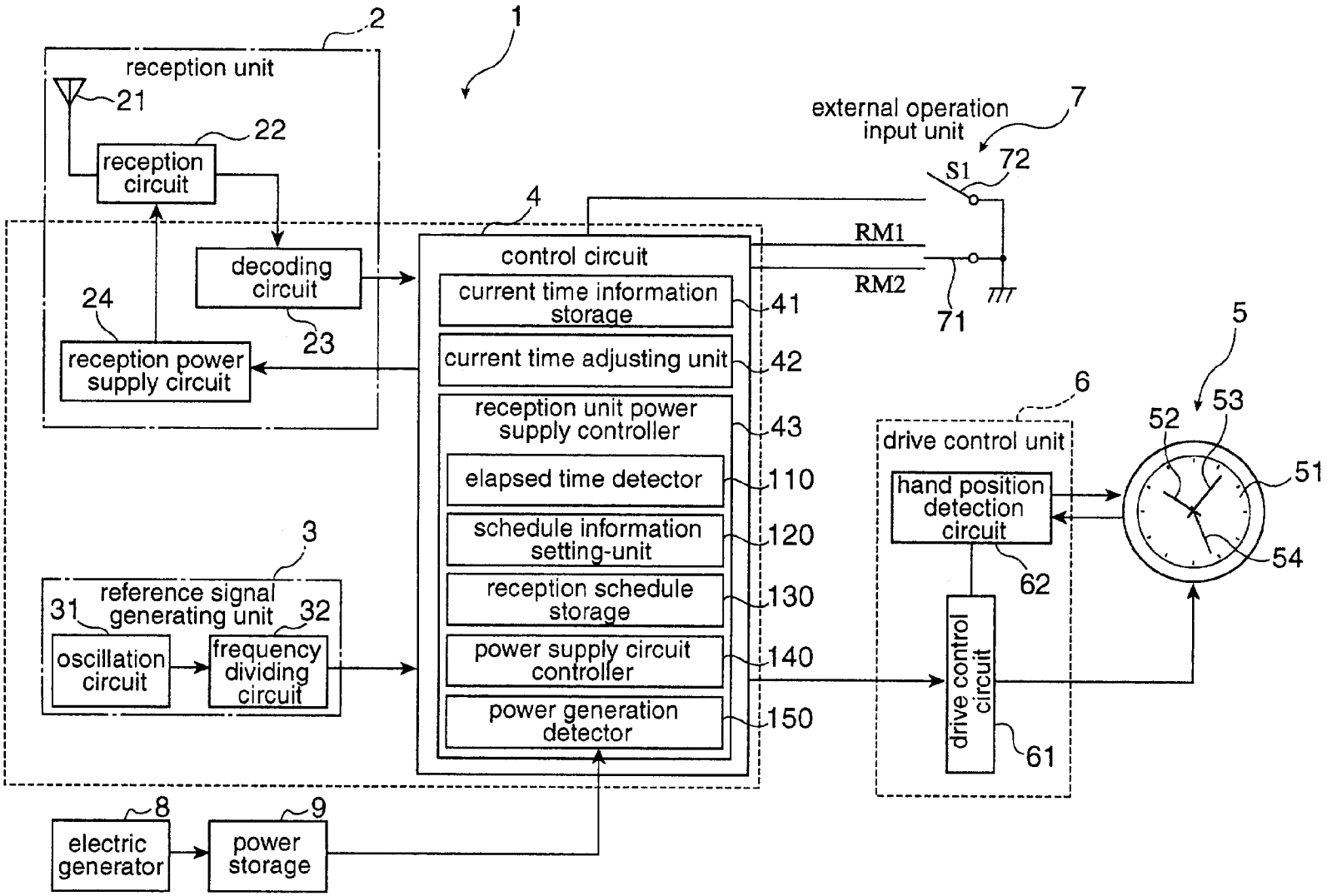
FIG. 5 shows the configuration of a radio-controlled timepiece according to a second embodiment of the present invention.
Figure 6:
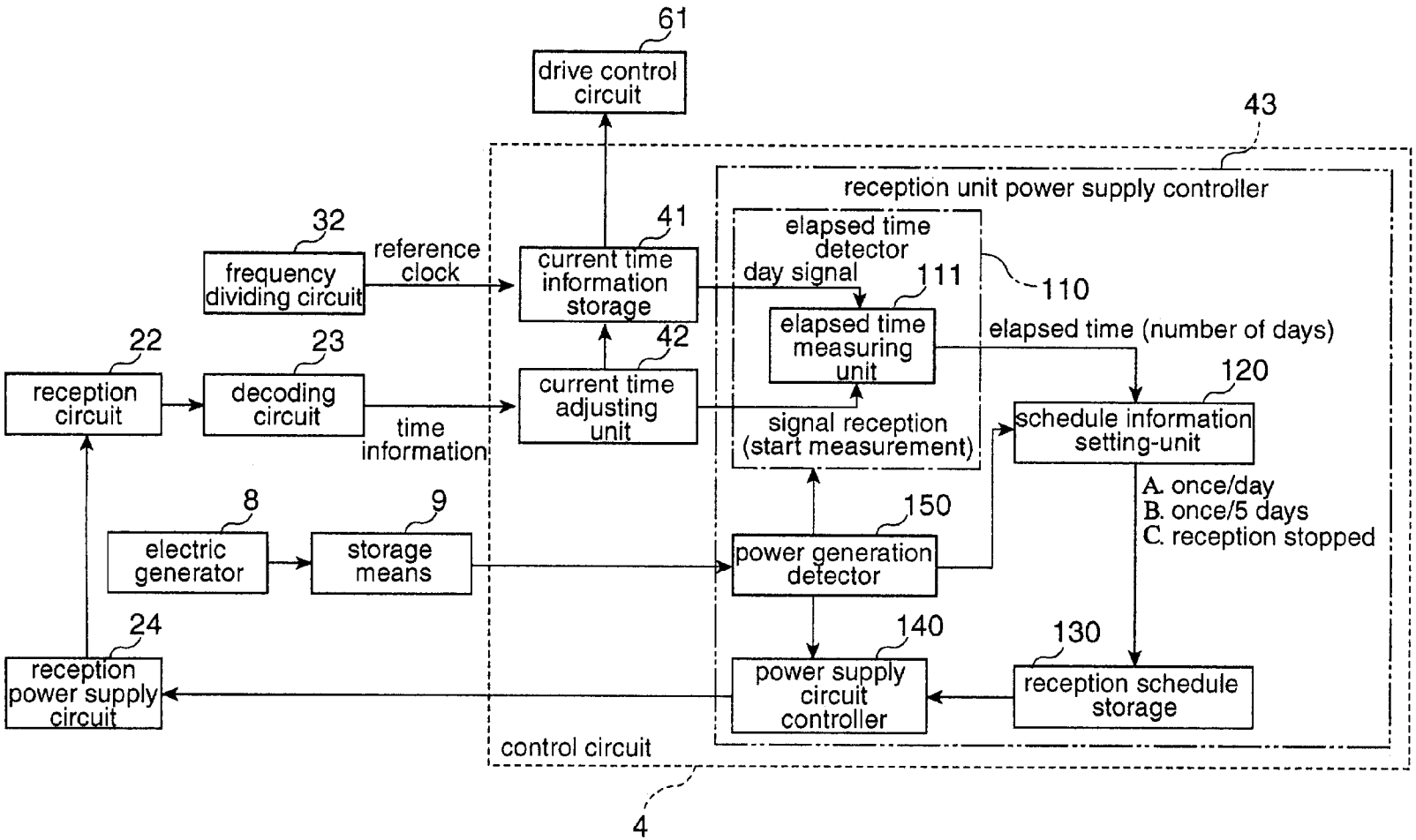
FIG. 6 is a block showing the configuration of the control circuit in the second embodiment.

The reception process shown in FIG. 4 is run by a reception control procedure if S4 determines that it is the automated reception time or a forced reception command was detected in S1.

The reception process shown in FIG. 4 starts by the power supply circuit controller 140 operating the reception power supply circuit 24 and the reception circuit 22 turning on (S11).

When the reception circuit 22 operates the time signal is received by the antenna 21, and the time data (time information) is stored by way of reception circuit 22 and decoding circuit 23 to the current time adjusting unit 42 (S12). In other words, the reception procedure runs.

When the power supply circuit controller 140 operates the reception circuit 22 for about three minutes and receives three frames of time information, it stops the reception power supply circuit 24 and turns the reception circuit 22 off (S13).

The current time adjusting unit 42 then confirms whether the stored time information is accurate time data, and determines whether reception was successful (S14). More specifically, it determines if the stored time data indicates a non-existing time or date, such as minute 68 of the hour, and whether the consecutively received time data indicate the expected times. In other words, successively received time data should indicate times that are one minute apart. It is therefore possible to confirm whether the time data is accurate and whether reception was successful based on whether or not the received time data indicates the expected values.

If reception is determined successful in S14, the current time adjusting unit 42 outputs a signal telling the elapsed time measuring unit 111 to start measuring the elapsed time. The elapsed time measuring unit 111 therefore starts measuring the elapsed time and the elapsed time detection process starts (S15).

If reception was successful, the default setting, i.e., schedule information A (receive automatically once/day) is set as the reception schedule stored to the reception schedule storage 130 (S16). So that the time signal is regularly automatically received, the automated reception flag is set to 1 (S17).

Based on the time information in the received time signal, the current time adjusting unit 42 rewrites the content of the current time information storage 41 and runs the current time adjusting process to adjust the current time displayed on the display unit 5 via the drive control circuit 61 (S18).

Automated reception of the time signal thereafter repeats at the rate of once a day based on schedule information A. If time signal reception is poor or if the radio-controlled timepiece 1 is located in a place with poor reception conditions and time signal reception therefore fails in S14, the schedule information setting-unit 120 references the elapsed time information counted by the elapsed time measuring unit 111 and determines if the time elapsed since time signal reception is 20 days or more (S20).

If the elapsed time is less than 20 days, whether the elapsed time is 7 days or less is determined (S21). If seven days or more have passed (i.e., if the elapsed time is 7 or more days and less than 20 days), the schedule information setting-unit 120 runs the schedule information setting procedure to update the schedule information stored to the reception schedule storage 130 from the default setting (i.e., schedule information A) to schedule information B (S22). This schedule information B schedules time signal reception once every five days, that is, is schedule information with a longer interval between when power is supplied than the default setting.

As a result, the frequency of the automated time signal reception process is changed from once a day to once every five days.

If less than seven days is determined to have passed in S21, the schedule information is not updated and the time signal reception process continues once per day.

If 20 days or more are determined to have elapsed in S20, the automated reception flag is set to 0, that is, the stop-automated-reception mode is set (S23).

When this stop-automated-reception mode is set the time signal is not received until a forced reception command (S1) is asserted.

To summarize the above process, time signal reception continues once per day during normal operation, but if seven days pass from a previous reception during which the time signal cannot be received, reception is delayed to the rate of once every five days. If the time signal reception continues to fail for a total 20 days since the last successful reception, time signal reception is then stopped.

The once-every-5-days reception mode is then cancelled if the standard time signal is successfully received during either automated reception or forced reception, and the default once/day reception mode is restored.

The stop-automated-reception mode is cancelled if the user manually forces reception and the time signal is successfully received.

This embodiment of the invention provides the following benefits.

(1) When the elapsed time since a standard time signal was received reaches or exceeds a set time (7 days), the power supply circuit controller 140 that controls power supply to the reception circuit 22 changes from a once/day time signal reception process to a once-every-5-days process. The frequency of the reception process can therefore be reduced. Furthermore, because if the signal cannot be received for seven days the radio-controlled timepiece 1 is normally located inside a building or other location where signal reception is difficult, or it is being used under conditions where signal reception is not possible, such as travelling overseas or other out-of-range locale, the likelihood is high that reception will continue to fail even if it is attempted once a day and the attempted reception processes will be wasted, thus needlessly consuming power.

With this embodiment of the invention, however, the signal reception interval is increased five times in this case to once every five days, thereby reducing the frequency of the signal reception process and decreasing power consumption accordingly. In a battery-powered wristwatch, for example, this can significantly improve battery life.

It should be noted that when signal reception is not possible the radio-controlled timepiece 1 operates with the same movement control as a typical quartz watch, can therefore assure precision of +/−20 seconds per month, and presents no problem with respect to normal use even if signal reception is not possible. Furthermore, if the time signal can be received it automatically resets to a more accurate time, and therefore can provide even higher precision.

Because the interval (frequency) of the reception process can thus be changed according to whether the time signal is received, the present embodiment can provide a radio-controlled timepiece 1 with excellent energy efficiency and long battery life.

(2) Furthermore, if the elapsed time is equal to or exceeds a second set time (20 days), the power supply circuit controller 140 stops automated reception of the standard time signal and the signal reception process does not run until forced reception is manually activated. Power consumption can therefore be even further reduced and battery life can be extended even further in a battery-powered wristwatch. Energy can likewise be conserved in a clock that uses a commercial power supply from an outlet.

(3) Because the elapsed time detector 110 is composed of an elapsed time measuring unit 111 for counting a reference clock from when time signal reception succeeds, elapsed time information is always recorded in the elapsed time measuring unit 111 and the elapsed time can be easily confirmed because the data can be simply read and confirmed.

A second embodiment of the present invention is described next with reference to FIG. 5 to FIG. 8. It should be noted that like parts in this and the first embodiment are referred to by like reference numerals, and further description thereof is either omitted or abbreviated.

A radio-controlled timepiece 1A according to this second embodiment differs from the above radio-controlled timepiece 1 in that it also has an electric generator 8 and power storage 9, and a power generation detector 150 for detecting the generating state of the electric generator 8 disposed in the reception unit power supply controller 43. It is otherwise configured the same as the radio-controlled timepiece 1 of the first embodiment, and further description is therefore omitted.

The electric generator 8 could be any device for generating and outputting electric power (electrical energy) as the result of some external energy input. Various types of generators could be used, including, for example, a solar battery for converting solar energy to electrical energy, a piezoelectric device (piezoelectric element) for converting mechanical stress to electrical energy, a floating electric wave power generator for converting stray electromagnetic waves to electrical energy, a thermoelectric generating element for converting temperature differences to electrical energy, or an electric generator that converts mechanical energy from a rotary pendulum or spring, for example, to electrical energy.

The power storage 9 could be a capacitor, storage cell, or other device capable of storing electric power.

The power generation detector 150 detects the voltage generated by the electric generator 8, that is, the voltage charge of the power storage 9, to detect the generating state, and is constructed to determine that power is being generated (power generation detection flag=1) when the voltage in the power storage is greater than or equal to a set voltage.

It should be noted that the power generation detector 150 shall not be limited to making a decision based on the voltage charge of the power storage 9. It could, for example, detect the voltage generated by the electric generator 8 and decide based on whether the generated voltage is greater than or equal to a set voltage. Alternatively, the power generation detector 150 could determine that power is being generated if the electric generator 8 generates power for at least a time set for detecting power generation within a specified period, and could determine that power was not generated if otherwise. For example, if the specified period is 24 hours (1 day), the time set for detecting power generation is 10 minutes, and power was generated for at least ten minutes per day, the electric generator 8 could be determined to have generated power, and to not have generated power if less than 10 minutes.

Whether power is generated could also be determined by detecting if the slope of the charging voltage, defined as the charging voltage/time, is greater than a specified slope.

In other words, the power generation detector 150 could be any device capable of determining if the required power is produced by the electric generator 8 and if the signal reception schedule can be reset to the default schedule because the power supply will not interfere with the signal reception process.

Operation of a radio-controlled timepiece 1A according to the present embodiment is described next with reference to the flow charts in FIGS. 7 and 8.

Figure 7:
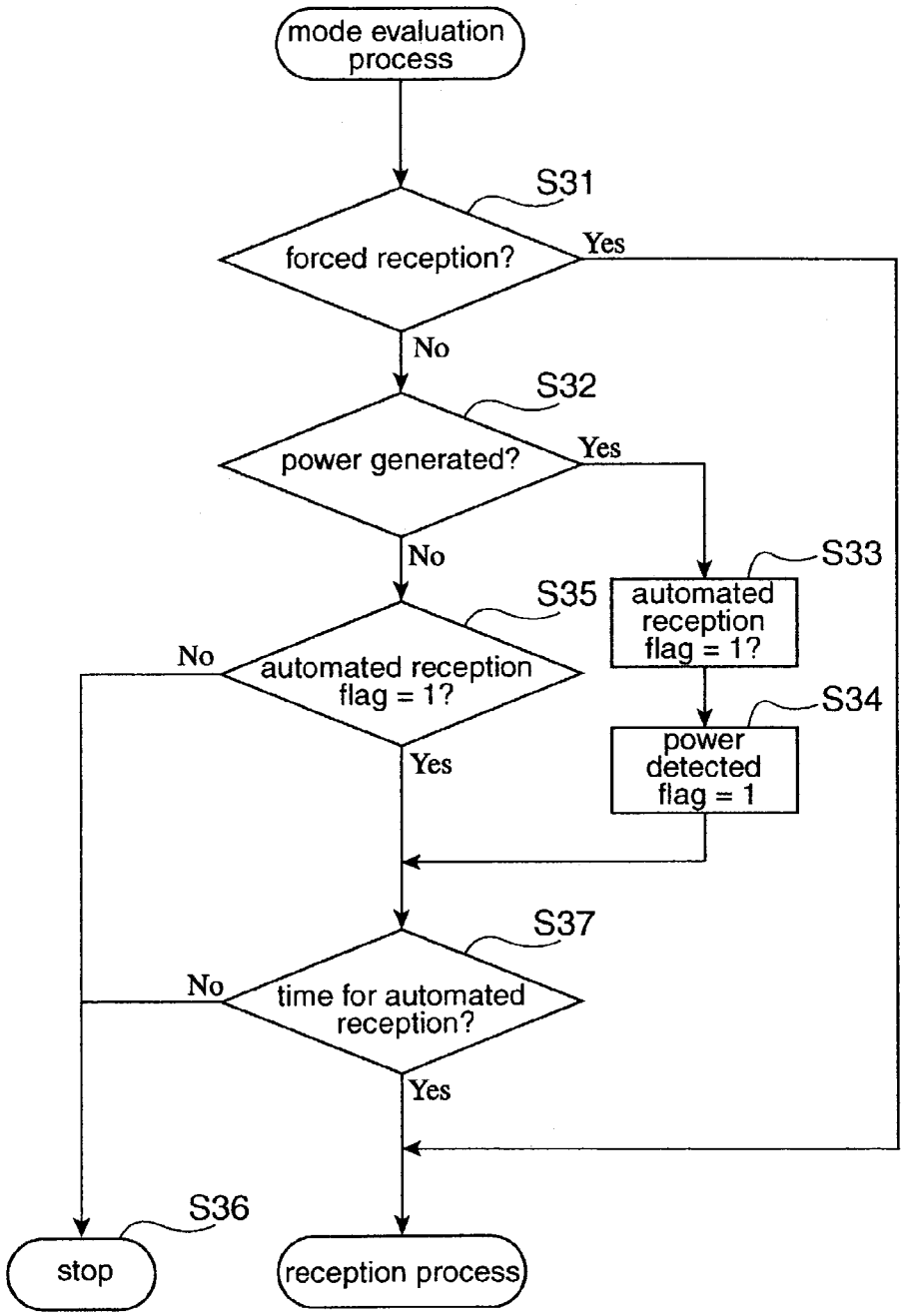
FIG. 7 is a flow chart showing the operation of the mode evaluation process during signal reception in the second embodiment.

FIG. 7 is a flow chart of a mode evaluation process such as shown in FIG. 3. As in the first embodiment, the reception unit power supply controller 43 of the control circuit 4 first determines if a forced reception command was asserted by a button operation (S31).

If a forced reception command is not detected, the power generation detector 150 runs a power generation detection process to determine whether power is being generated (S32). If power generation is detected, the automated reception flag is set to 1 (S33) and the power detected flag is also set to 1 (S34). It should be noted that as in the first embodiment the automated reception flag is set to 1 by default, and is set to 0 when reception is stopped in the flow chart shown in FIG. 8 as described below. Therefore, even if the automated reception flag is set to 0 and the stop-automated-reception mode is set, the stop-automated-reception mode is forcibly cancelled if power generation is detected, and the automated reception mode is reset (automated reception flag =1).

The power detected flag is set to 0 by default to denote no power generation, and is set to 1 when power generation is detected. As described below, this power detected flag is reset to the default (0) when measuring the elapsed time starts.

If no power generation is detected in S32, whether the automated reception flag is set to 1, that is, whether the automated reception mode is set, is determined (S35). If the automated reception flag is set to 0, that is, the stop-automated-reception mode is set, the mode evaluation process ends (S36).

If in S35 the automated reception flag is set to 1, or power generation is detected in S32, whether it is time for automated reception is determined (S37). If it is not time for automated reception, the mode evaluation process ends (S36).

Figure 8:
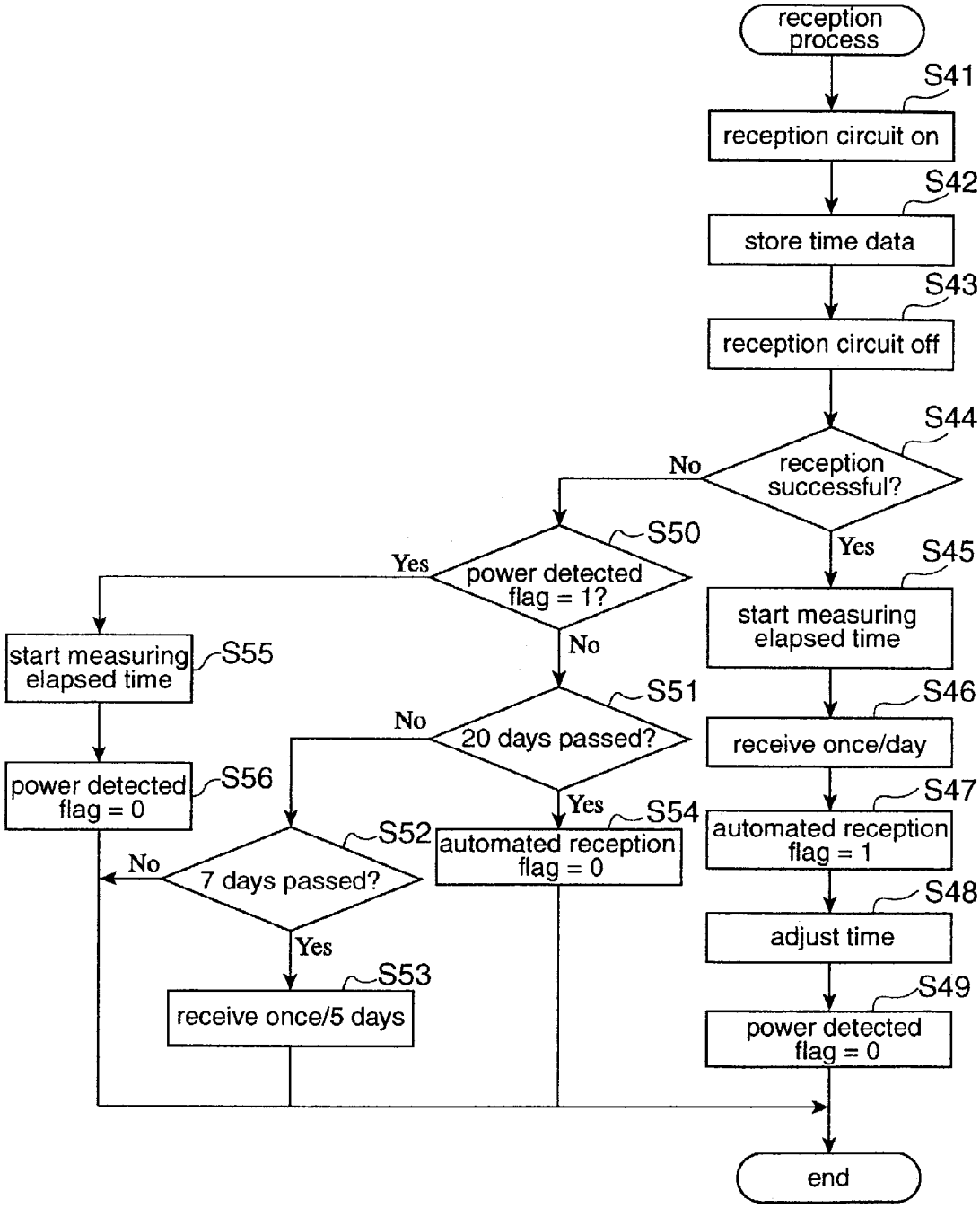
FIG. 8 is a flow chart showing the operation of the signal reception process in the second embodiment.

The reception process shown in FIG. 8 runs if S37 determines it is the automated reception time or if a forced reception command is detected in S31. It should be noted that in FIG. 8 the procedure from turning the reception circuit on (S41) to reception success (S44), and the procedure from S45 to S48 if S44 returns yes, are the same as the process from S11 to S18 in FIG. 4, and further description thereof is therefore omitted.

If reception is successful in the present embodiment a step (S49) for initializing the power detected flag runs in conjunction with steps S45 to S48. That is, the power detected flag indicates if power generation was detected after measuring the elapsed time started, and must be reinitialized each time measuring the elapsed time restarts.

If signal reception failed in S44, whether the power detected flag is set to 1 is determined (S50).

If the power detected flag=0 (no power generation), the schedule information setting-unit 120 checks the elapsed time counted by the elapsed time measuring unit 111 as in the first embodiment to determine if 20 days or more have passed since the last successful signal reception (S51).

If the elapsed time is less than 20 days, whether the elapsed time is 7 days or more is determined (S52), and if 7 or more days have passed (i.e., if the elapsed time is 7 days or more and less than 20 days), the schedule information setting-unit 120 updates the schedule information stored in the reception schedule storage 130 from the default setting (schedule information A) to schedule information B as in the first embodiment (S53).

This changes the automated signal reception process heretofore set to once a day to run at a frequency of once every five days.

Furthermore, because the schedule information is not updated if S52 determines that less than seven days have passed, the signal reception process continues to run once a day.

Moreover, if S51 determines that 20 days or more have passed, the automated reception flag is set to 0, that is, the stop-automated-reception mode is set (S54).

When the stop-automated-reception mode is set the signal reception process does not run unless a forced reception command is asserted (S1) or until power generation is detected in S32, the automated reception flag is changed to 1, and the stop-automated-reception mode is cancelled.

If S50 determines the power detected flag is set to 1 (power generation is detected), the elapsed time measuring unit 111 restarts measuring the elapsed time (S55), and resets the power detected flag to 0 (S56).

This embodiment of the invention provides the same operational effects as the first embodiment.

In addition, (4) by providing an electric generator 8 and a power generation detector 150 for detecting power generation by the electric generator 8, the automated reception flag can be reset to 1 in S33 and the reception process run if power is generated, and because elapsed time measurement is restarted in S54 if power is generated even if reception fails, the normal reception schedule at one day intervals can be continued. In other words, because the need to extend the reception interval to conserve power is reduced if power is generated, improving time precision through time signal reception can be given priority over saving energy, and better performance can be extracted from the radio-controlled timepiece 1A. Further, if no power is generated, such as when a timepiece with a built-in solar battery is placed inside a drawer such that no power is produced, an energy conservation mode can be automatically activated similarly to the first embodiment. The signal reception process can therefore be prioritized when the necessary power is obtained by the electric generator 8, and when power is not produced energy conservation can be prioritized to increase the signal reception interval and increase the operating time of the timepiece, and a radio-controlled timepiece 1A with both an accurate time display and operating time can be provided. (5) In the first embodiment the stop-automated-reception mode could not be cancelled unless reception was successful as a result of forced reception when the automated reception flag is set to 0. The present embodiment, however, can set the automated reception flag to 1 and cancel the stop-reception mode if power generation is detected in S32. The automated reception mode can therefore be automatically resumed, and a radio-controlled timepiece 1A with excellent ease of use can be provided.

The present invention shall not be limited to the embodiments described above, and variations and improvements that also achieve the object of the present invention are included within the scope of this invention.

Figure 9:
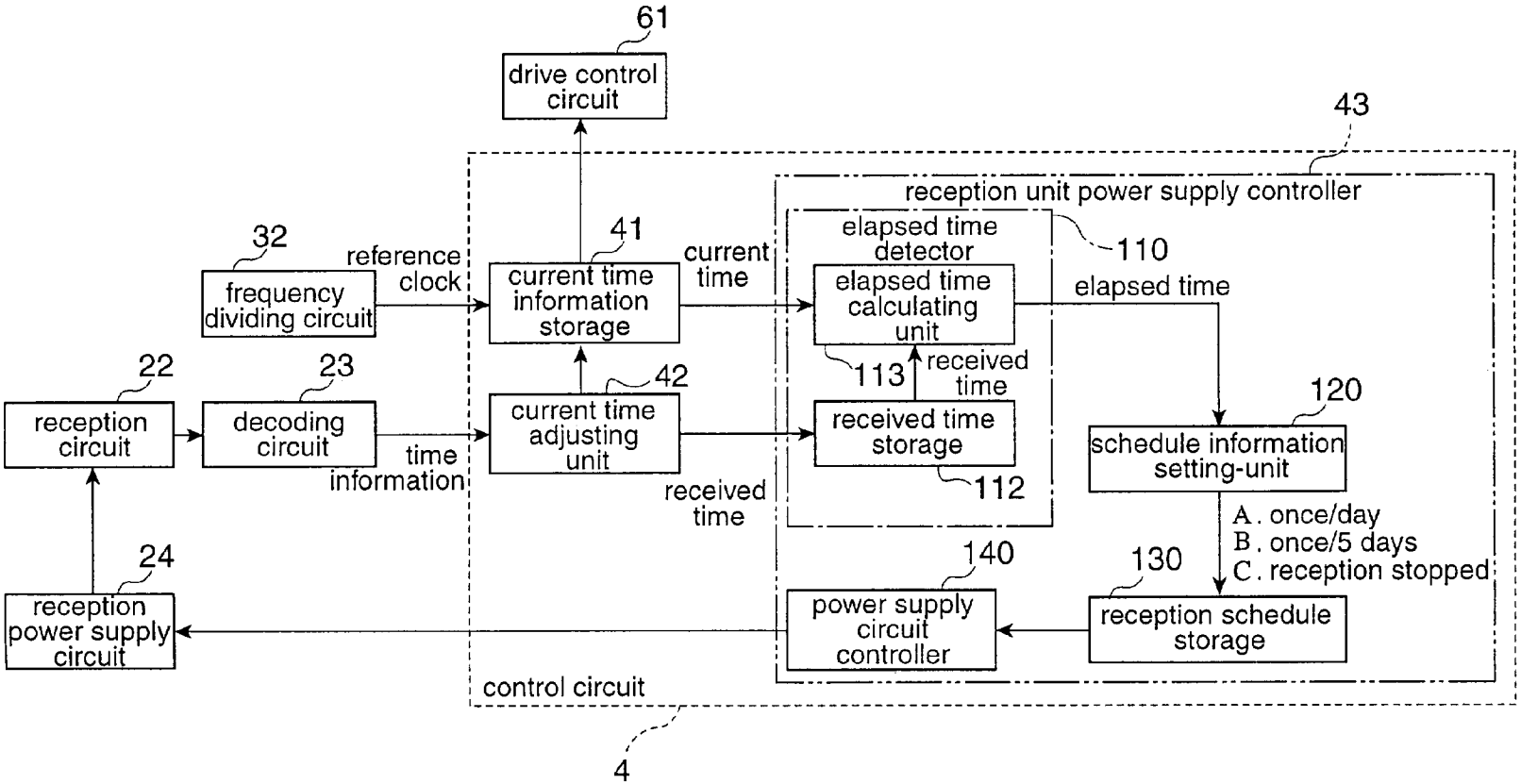
FIG. 9 is a block diagram showing the configuration of a control circuit in an alternative embodiment of the invention.

The elapsed time detector 110, for example, could be a device for calculating the difference between the received time and the current time to obtain the elapsed time as shown in FIG. 9. In other words, the elapsed time detector 110 could calculate the elapsed time using a received time storage 112 storing the received time (adjustment time) input from the current time adjusting unit 42, and an elapsed time calculating unit 113 for calculating the elapsed time as the difference between the received time stored in this received time storage 112 and the current time information from the current time information storage 41. A benefit of this configuration is that power consumption can be reduced because the elapsed time calculating unit 113 is operated only when calculating the elapsed time. More specifically, the radio-controlled timepiece 1 basically receives the time signal only once a day, and it is therefore sufficient for the schedule information setting-unit 120 to determine the elapsed time only once a day. It is therefore sufficient for the elapsed time calculating unit 113 to also calculate the elapsed time only once a day, and power consumption can be reduced accordingly.

Furthermore, while the preceding embodiments provide control stopping operation of the reception circuit 22 when the elapsed time equals or exceeds a second set time (20 days), it is alternatively possible to continue the reception mode at the rate of once every five days, for example, even when 20 days or more have passed instead of implementing a process for stopping the reception circuit 22. While power consumption is reduced accordingly by completely stopping the reception circuit 22, attempting signal reception approximately once every five days still reduces power consumption compared with daily reception. The benefits of improved power conservation and an increased battery life can therefore still be achieved to some degree.

Yet further, because reception once every five days still occurs automatically, signal reception can be resumed automatically without manual intervention by the user, and operability is improved accordingly.

This embodiment uses only two schedules for time signal reception, schedule information A for receiving once a day and schedule information B for receiving once every five days, but other schedules could be defined, including once in two days, once in seven days, once in ten days, or other time interval. If plural set times are also defined, the reception schedule could be changed to gradually increase the interval between receptions as the elapsed time from the last successful signal reception passes each set time.

Particularly when the reception-stopped mode is eliminated and the elapsed time passes 20 days, for example, setting a reception schedule of once in ten days is desirable to improve energy conservation.

The previous embodiments also continue time signal reception every day until seven days pass without successful reception, but the reception schedule could also be changed in increments, for example, to a once in two days after three days pass and then to once in five days after seven days pass.

Figure 10:
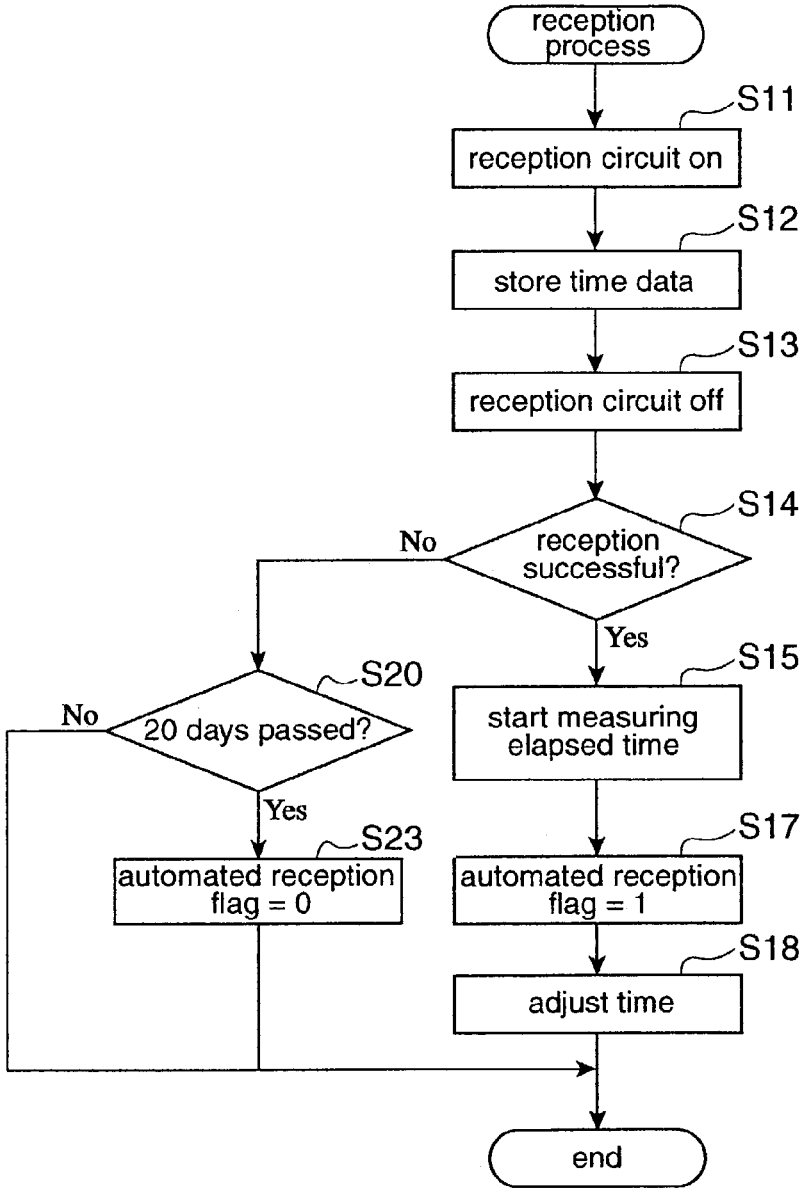
FIG. 10 is a flow chart showing the operation of the signal reception process in this alternative embodiment of this invention.

The schedule information set by the schedule information setting-unit 120 could also be limited to schedule information A setting the default once/day schedule, and schedule information C whereby reception is stopped. In this case, as shown in FIG. 10, the automated reception flag is set to 0 to stop the signal reception process only when the elapsed time is 20 days or longer (S20), and reception otherwise continues once a day according to schedule information A.

Furthermore, the schedule information setting-unit 120 is described selecting one of plural predefined schedules according to the elapsed time and whether power is generated, but an operating unit could also be provided for calculating the schedule using the elapsed time and whether power generation is detected as parameters.

An elapsed time display for displaying the elapsed time could also be provided in the radio-controlled timepiece 1 so that the user can know how long it has been since the current time signal could not be received. This elapsed time display could, for example, move the second hand 54 one second per day on the face to indicate how many days have passed when an elapsed time display mode is selected using the crown or pushbutton, or an LCD could be provided in the face to digitally indicate how many days have passed. By providing such display the user can easily know how many days have passed without being able to receive the time signal. This has the advantage of the user thus knowing that the timepiece is operating with the precision of a normal quartz timepiece because the time has not been adjusted as a result of time signal reception.

By providing a voltage detector for detecting the battery voltage similarly to the second embodiment in a battery-powered radio-controlled timepiece not having an electric generator 8, measuring the elapsed time can be restarted or the automated reception flag can be reset to 1 if the battery voltage is greater than or equal to a set voltage.

Furthermore, a power generation detector 150 is provided in the second embodiment to detect power generation by the electric generator 8, but power generation could alternatively be detected by detecting the external energy supplied to the electric generator 8, for example. For example, if a thermoelectric generator is used the temperature difference could be detected with a thermometer, and if the temperature difference is greater than or equal to a specified temperature difference it could be determined that a specified amount of power is produced and it could therefore be determined that power is being generated. If mechanical energy is input by a spring, for example, power generation could be determined according to the winding of the spring.

Furthermore, the functional units inside the control circuit 4 can be achieved with a hardware configuration of various logic devices, or a microprocessor with a CPU and memory could be disposed inside the radio-controlled timepiece 1 with a control program and data (the data stored in the storage units) embedded in the microprocessor to achieve the various functions.

For example, a CPU and memory functioning as a computer could be integrated into the radio-controlled timepiece 1, a specific control program and data could be installed in the memory via the Internet or other communications form, or from a recording medium such as CD-ROM or a memory card, and the CPU could run the installed program and use the stored data to achieve the various functions.

It should be noted that the control program could be installed in the radio-controlled timepiece 1 by directly inserting a memory card, CD-ROM, or other storage medium in to he radio-controlled timepiece 1, or a device for reading such media could be externally connected to the radio-controlled timepiece 1. A LAN cable or phone line, for example, could also be connected to the radio-controlled timepiece 1 to install the program and data by way of data communication, or because the timepiece has an antenna 21 the program could be installed through a wireless connection.

If a control program supplied from such storage media or communications path such as the Internet can be installed to he radio-controlled timepiece 1, the features and functions of the present invention can be achieved by simply modifying the installed control program. This enables the program to be installed when the timepiece is shipped from the factory, and even enables the user to select the desired program for installation at a later date. Because it is therefore possible to manufacture radio-controlled timepieces 1 with different control methods by simply changing the control program, products can be provided with a common design, greatly reducing the manufacturing cost while offering a wide variation of products.

Functions of this radio-controlled timepiece, specifically the configuration of the timekeeping unit, reception unit, and time adjusting unit, for example, shall not be limited to the embodiments described above, and devices from radio-controlled timepieces known from the prior art can be utilized in the present invention.

The radio-controlled timepiece 1 of the present invention shall also not be limited to an analog timepiece. It could be a digital timepiece, or a timepiece having hands for an analog display together with a liquid crystal display for a digital display.

Furthermore, the radio-controlled timepiece 1 could be a portable timepiece such as a wristwatch or pocketwatch, a stationary timepiece such as wall clock or mantle clock, or various other types of clocks.

Other preferred embodiments of the invention are described next below.

A first control program for a radio-controlled timepiece according to the present invention is run by a computer embedded in a radio-controlled timepiece. The radio-controlled timepiece has a timekeeping unit that measures the current time based on a reference clock, a current time display that displays the measured current time, a reception unit that receives a radio signal containing time information, a reception power supply controller that regularly operates a reception power supply that drives the reception unit, and a current time adjusting unit that adjusts the current time of the timekeeping unit based on the time information received by the reception unit.

By running the control program the computer functions as an elapsed time detector that determines the elapsed time from when the previous radio signal was received, a schedule information setting-unit that sets schedule information defining the operating time interval at which the reception power supply is regularly operated, and changing the schedule information to schedule information with a longer operating time interval than a default setting when the elapsed time becomes greater than or equal to the set time, and a power supply controller that controls operation of the reception power supply based on the schedule information.

The reception power supply controller is composed of the elapsed time detector, schedule information setting-unit, and power supply controller.

A second control program for a radio-controlled timepiece according to the present invention is run by a computer embedded in a radio-controlled timepiece. This radio-controlled timepiece has a timekeeping unit that measures the current time based on a reference clock, a current time display that displays the measured current time, a reception unit that receives a radio signal containing time information, a reception power supply controller that regularly operates a reception power supply that drives the reception unit, a current time adjusting unit that adjusts the current time of the timekeeping unit based on the time information received by the reception unit, an electric generator that produces electric power using energy from an external source, and a power storage that stores power generated by the electric generator.

By running the control program the computer functions as a power generation detector that detects electric power generation by an electric generator, an elapsed time detector that determines the elapsed time from when the previous radio signal was received, a schedule information setting-unit that sets schedule information defining the operating time interval at which the reception power supply is regularly operated, and changing the schedule information to schedule information with a longer operating time interval than a default setting when the elapsed time becomes greater than or equal to the set time and power generation was not detected even once after elapsed time measurement started, and a power supply controller that controls operation of the reception power supply based on the schedule information.

The reception power supply controller is composed of the electric generator, elapsed time detector, schedule information setting-unit, and power supply controller.

A third control program for a radio-controlled timepiece according to the present invention is run by a computer embedded in a radio-controlled timepiece. This radio-controlled timepiece has a timekeeping unit that measures the current time based on a reference clock, a current time display that displays the measured current time, a reception unit that receives a radio signal containing time information, a reception power supply controller that regularly operates a reception power supply that drives the reception unit, and a current time adjusting unit that adjusts the current time of the timekeeping unit based on the time information received by the reception unit.

By running the control program the computer functions as a an elapsed time detector that determines the elapsed time from when the previous radio signal was received, a schedule information setting-unit that sets schedule information defining the operating time interval at which the reception power supply is regularly operated, and a power supply controller that controls operation of the reception power supply based on the schedule information, stopping regular operation of the reception power supply and stopping driving the reception unit when the elapsed time is greater than or equal to a set time.

The reception power supply controller is composed of the elapsed time detector, schedule information setting-unit, and power supply controller.

A fourth control program for a radio-controlled timepiece according to the present invention is run by a computer embedded in a radio-controlled timepiece. This radio-controlled timepiece has a timekeeping unit that measures the current time based on a reference clock, a current time display that displays the measured current time, a reception unit that receives a radio signal containing time information, a reception power supply controller that regularly operates a reception power supply that drives the reception unit, a current time adjusting unit that adjusts the current time of the timekeeping unit based on the time information received by the reception unit, an electric generator that produces electric power using energy from an external source, and a power storage that stores power generated by the electric generator.

By running the control program the computer functions as a an elapsed time detector that determines the elapsed time from when the previous radio signal was received, a power generation detector that detects electric power generation by the electric generator, a schedule information setting-unit that sets schedule information defining the operating time interval at which the reception power supply is regularly operated, and a power supply controller that controls operation of the reception power supply based on the schedule information, stopping regular operation of the reception power supply and stopping driving the reception unit when the elapsed time is greater than or equal to a set time and power generation was not detected even once after elapsed time measurement started.

The reception power supply controller is composed of the electric generator, elapsed time detector, schedule information setting-unit, and power supply controller.

A computer-readable recording medium for recording a radio-controlled timepiece control program according to a fifth through an eighth embodiment of the invention is characterized by recording a control program as described in one of the above first to fourth control programs.

Effects of the invention

As described above, a radio-controlled timepiece and a control method for a radio-controlled timepiece according to the present invention can suppress unnecessary power consumption and improve energy conservation.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A radio-controlled timepiece comprising:

a timekeeping unit that measures current time based on a reference clock;

a current time display that displays the measured current time;

a reception unit that receives a radio signal containing time information;

a reception power supply controller that regularly operates a reception power supply that drives the reception unit; and a current time adjusting unit that adjusts the current, time of the timekeeping unit based on the time information received by the reception unit;

the reception power supply controller comprising:

an elapsed time detector that determines an elapsed time from when a previous radio signal was received;

a schedule information setting-unit that sets schedule information defining an operating time interval at which the reception power supply is regularly operated; and a power supply controller that controls operation of the reception power supply based on the schedule information, the schedule information setting-unit changing the schedule information to schedule information with a longer operating time interval than a default setting when the elapsed time becomes greater than or equal to a set time.

2. A radio-controlled timepiece as described in claim 1, wherein the reception power supply controller comprises a reception schedule storage that stores the schedule information;

the schedule information setting-unit selecting schedule information from plural predefined reception schedules according to the elapsed time and storing the selected schedule information in the reception schedule storage, and the power supply controller controlling operation of the reception power supply based on the schedule information stored in the reception schedule storage.

3. A radio-controlled timepiece as described in claim 1, wherein the schedule information setting-unit receives radio signals from the reception unit, and sets the schedule information to the default setting when correct time information is received.

4. A radio-controlled timepiece as described in claim 1, wherein the power supply controller stops regular operation of the reception power supply when the elapsed time is greater than or equal to a second set time longer than said set time.

5. A radio-controlled timepiece as described in claim 1, further comprising an external operation input unit enabling external operation, the reception power supply controller operating the reception power supply when forced reception is asserted by operation of the external operation input unit.

6. A radio-controlled timepiece as described in claim 1, wherein the elapsed time detector comprises an elapsed time measuring unit that uses the reference clock to measure the time elapsed since reception of time information by the reception unit.

7. A radio-controlled timepiece as described in claim 1, wherein the elapsed time detector comprises a received time storage that stores time information received by the reception unit; and an elapsed time calculating unit that calculates elapsed time from reception of the time information by the reception unit by calculating a time difference between received time information stored in the received time information storage and a current time measured by the timekeeping unit.

8. A radio-controlled timepiece comprising:

a timekeeping unit that measures current time based on a reference clock;

a current time display that displays the measured current time;

a reception unit that receives a radio signal containing time information;

a reception power supply controller that regularly operates a reception power supply that drives the reception unit; and a current time adjusting unit that adjusts the current time of the timekeeping unit based on the time information received by the reception unit, an electric generator that produces electric power using energy from an external source, and a power storage that stores power generated by the electric generator;

the reception power supply controller comprising:

a power generation detector that detects electric power generation by the electric generator;

an elapsed time detector that determines the elapsed time from when a previous radio signal was received;

a schedule information setting-unit that sets schedule information defining the operating time interval at which the reception power supply is regularly operated; and a power supply controller that controls operation of the reception power supply based on the schedule information, the schedule information setting-unit changing the schedule information to schedule information with a longer operating time interval than a default setting when the elapsed time becomes greater than or equal to a set time and power generation is not detected even once after elapsed time measurement starts.

9. A radio-controlled timepiece as described in claim 8, wherein the reception power supply controller comprises a reception schedule storage that stores the schedule information the schedule information setting-unit selects schedule information from plural predefined reception schedules according to the elapsed time and whether power generation was detected and stores the selected schedule information in the reception schedule storage, and the power supply controller controls operation of the reception power supply based on the schedule information stored in the reception schedule storage.

10. A radio-controlled timepiece as described in claim 8, wherein the schedule information setting-unit receives radio signals from the reception unit, and sets the schedule information to a default setting when correct time information is received.

11. A radio-controlled timepiece as described in claim 8, wherein the schedule information setting-unit sets the schedule information to the default setting when power generation is detected by the power generation detector.

12. A radio-controlled timepiece as described in claim 8, wherein the power supply controller stops regular operation of the reception power supply when the elapsed time is greater than or equal to a second set time longer than said set time.

13. A radio-controlled timepiece as described in claim 8, wherein the elapsed time detector resets and restarts measuring the elapsed time when power generation is detected by the power generation detector.

14. A radio-controlled timepiece as described in claim 8, further comprising an external operation input unit enabling external operation, the reception power supply controller operating the reception power supply when forced reception is asserted by operation of the external operation input unit.

15. A radio-controlled timepiece as described in claim 8, wherein the elapsed time detector comprises an elapsed time measuring unit that uses the reference clock to measure the time elapsed since reception of time information by the reception unit.

16. A radio-controlled timepiece as described in claim 8, wherein the elapsed time detector comprises a received time storage that stores time information received by the reception unit; and an elapsed time calculating unit that calculates elapsed time from reception of the time information by the reception unit by calculating a time difference between received time information stored in the received time information storage and a current time measured by the timekeeping unit.

17. A radio-controlled timepiece comprising:

a timekeeping unit that measures current time based on a reference clock;

a current time display that displays the measured current time;

a reception unit that receives a radio signal containing time information;

a reception power supply controller that regularly operates a reception power supply that drives the reception unit;

a current time adjusting unit that adjusts the current time of the timekeeping unit based on the time information received by the reception unit;

an electric generator that produces electric power using energy from an external source; and a power storage that stores power generated by the electric generator:

the reception power supply controller comprising:

an elapsed time detector that determines elapsed time from when a previous radio signal was received;

a power generation detector that detects electric power generation by the electric generator;

a schedule information setting-unit that sets schedule information defining an operating time interval at which the reception power supply is regularly operated; and a power supply controller that controls operation of the reception power supply based on the schedule information, the power supply controller stopping regular operation of the reception power supply and stopping driving the reception unit when the elapsed time is greater than or equal to a set time and power generation is not detected even once after elapsed time measurement starts.

18. A radio-controlled timepiece as described in claim 17, wherein the power supply controller resumes regular operation of the reception power supply if power generation by the electric generator is detected while regular operation of the reception power supply is stopped.

19. A radio-controlled timepiece as described in claim 17, further comprising an external operation input unit enabling external operation, the reception power supply controller operating the reception power supply when forced reception is asserted by operation of the external operation input unit.

20. A radio-controlled timepiece as described in claim 17, wherein the elapsed time detector comprises an elapsed time measuring unit that uses the reference clock to measure the time elapsed since reception of time information by the reception unit.

21. A radio-controlled timepiece as described in claim 17, wherein the elapsed time detector comprises a received time storage that stores time information received by the reception unit; and an elapsed time calculating unit that calculates elapsed time from reception of the time information by the reception unit by calculating a time difference between received time information stored in the received time information storage and a current time measured by the timekeeping unit.

22. A control method for a radio-controlled timepiece comprising:

measuring current time based on a reference clock, displaying the measured current time, receiving a radio signal containing time information, adjusting the current time based on the time information received in the receiving step, regularly running the receiving step based on set schedule information, determining an elapsed time from when a previous radio signal was received, and changing the schedule information to schedule information with a longer execution time interval than a default setting when the elapsed time is greater than or equal to a set time.

23. A control method for a radio-controlled timepiece comprising an electric generator that produces electric power using energy from an external source, and a power storage that stores power generated by the electric generator, the control method comprising:

measuring current time based on a reference clock, displaying the measured current time, receiving a radio signal containing time information, adjusting the current time based on the time information received in the receiving step, regularly running the receiving step based on set schedule information, measuring elapsed time from when a previous radio signal was received, detecting electric power generation by the electric generator, and changing the schedule information to schedule information with a longer execution time interval than a default setting when the elapsed time is greater than or equal to a set time and power generation is not detected even once after elapsed time measurement starts.

24. A control method for a radio-controlled timepiece comprising an electric generator that produces electric power using energy from an external source, and a power storage that stores power generated by the electric generator, the control method comprising:

measuring current time based on a reference clock, displaying the measured current time, receiving a radio signal containing time information, adjusting the current time based on the time information received in the receiving step, running the receiving step based on set schedule information, measuring elapsed time from when a previous radio signal was received, detecting electric power generation by the electric generator, and stopping running the receiving step when the elapsed time is greater than or equal to a set time and power generation is not detected even once after elapsed time measurement starts.

* * * * *